US011817029B2

(12) United States Patent
Pyun et al.

(10) Patent No.: US 11,817,029 B2
(45) Date of Patent: Nov. 14, 2023

(54) SCREEN SAVER CONTROLLER, DISPLAY DEVICE INCLUDING THE SAME, AND METHOD OF DRIVING THE DISPLAY DEVICE

(71) Applicant: Samsung Display Co., LTD., Yongin-si (KR)

(72) Inventors: Kihyun Pyun, Gwangmyeong-si (KR); Heesook Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/874,232

(22) Filed: Jul. 26, 2022

(65) Prior Publication Data

US 2023/0033713 A1 Feb. 2, 2023

(30) Foreign Application Priority Data

Jul. 27, 2021 (KR) ..... 10-2021-0098677

(51) Int. Cl.
*G09G 3/20* (2006.01)

(52) U.S. Cl.
CPC ..... *G09G 3/2007* (2013.01); *G09G 2310/027* (2013.01); *G09G 2310/08* (2013.01); *G09G 2320/0257* (2013.01); *G09G 2320/0295* (2013.01); *G09G 2320/046* (2013.01); *G09G 2320/103* (2013.01); *G09G 2330/022* (2013.01); *G09G 2330/023* (2013.01); *G09G 2360/16* (2013.01)

(58) Field of Classification Search
CPC ..... G09G 3/32; G09G 2320/0257; G09G 2320/0276
See application file for complete search history.

(56) References Cited

U.S. PATENT DOCUMENTS

| | | | | |
|---|---|---|---|---|
| 6,313,878 | B1 * | 11/2001 | Jankowiak | H04N 5/68 345/589 |
| 7,414,795 | B2 * | 8/2008 | Cok | G09G 3/3208 382/274 |
| 9,373,280 | B2 * | 6/2016 | Yoon | G09G 3/3233 |
| 9,524,676 | B2 * | 12/2016 | Bi | G09G 3/3233 |
| 9,754,541 | B2 * | 9/2017 | Takasaki | G09G 3/342 |
| 10,930,211 | B2 * | 2/2021 | Koh | G09G 3/3406 |
| 10,971,052 | B2 * | 4/2021 | Song | G09G 3/3275 |
| 10,991,317 | B2 * | 4/2021 | Byun | G09G 3/3233 |

(Continued)

FOREIGN PATENT DOCUMENTS

| | | |
|---|---|---|
| JP | 2016-0004099 | 1/2016 |
| KR | 10-1908513 | 10/2018 |

(Continued)

*Primary Examiner* — Michael J Jansen, II
(74) *Attorney, Agent, or Firm* — H.C. Park & Associates, PLC

(57) ABSTRACT

A screen saver controller including a load calculator configured to generate load data of an image represented by input image data, a maximum gray level calculator configured to generate maximum gray level data of the image represented by the input image data, and a screen saver data generator configured to determine a gain of a screen saver mode based on the load data and the maximum gray level data when the screen saver mode is operated and to generate screen saver data based on the input image data and the gain.

13 Claims, 8 Drawing Sheets

(56) References Cited

U.S. PATENT DOCUMENTS

| | | | | |
|---|---|---|---|---|
| 11,127,358 | B2 * | 9/2021 | Park | G09G 3/20 |
| 11,151,935 | B2 * | 10/2021 | Park | G09G 3/3233 |
| 11,189,226 | B2 * | 11/2021 | Pyun | G09G 3/3233 |
| 11,244,596 | B2 * | 2/2022 | Park | G09G 3/2092 |
| 11,557,268 | B2 * | 1/2023 | Pyun | G09G 5/10 |
| 2007/0262709 | A1 * | 11/2007 | Cok | G09G 3/3208 313/506 |
| 2014/0176625 | A1 * | 6/2014 | Yoon | G09G 3/3233 345/691 |
| 2014/0375704 | A1 * | 12/2014 | Bi | G09G 3/3275 345/694 |
| 2015/0364094 | A1 * | 12/2015 | Takasaki | G09G 3/342 345/593 |
| 2019/0213953 | A1 * | 7/2019 | Koh | G09G 3/3225 |
| 2020/0066199 | A1 * | 2/2020 | Song | G09G 3/3208 |
| 2020/0143751 | A1 * | 5/2020 | Byun | G09G 3/3233 |
| 2021/0134217 | A1 * | 5/2021 | Park | G09G 3/3233 |
| 2021/0256914 | A1 * | 8/2021 | Park | G09G 3/20 |
| 2021/0264877 | A1 * | 8/2021 | Pyun | G09G 3/3233 |
| 2021/0327338 | A1 * | 10/2021 | Park | G09G 3/3233 |
| 2022/0051624 | A1 * | 2/2022 | Pyun | G09G 3/3233 |
| 2022/0122517 | A1 * | 4/2022 | Park | G09G 3/22 |
| 2022/0165203 | A1 * | 5/2022 | Park | G09G 3/3233 |
| 2022/0254318 | A1 * | 8/2022 | Pyun | G09G 5/10 |
| 2023/0033713 | A1 * | 2/2023 | Pyun | G09G 3/2007 |

FOREIGN PATENT DOCUMENTS

| | | |
|---|---|---|
| KR | 10-1992904 | 6/2019 |
| KR | 10-2019-0084191 | 7/2019 |
| KR | 10-2020-0050584 | 5/2020 |
| KR | 10-2167102 | 10/2020 |

* cited by examiner

SCREEN SAVER CONTROLLER, DISPLAY DEVICE INCLUDING THE SAME, AND METHOD OF DRIVING THE DISPLAY DEVICE

CROSS-REFERENCE TO RELATED APPLICATION

This application claims priority from and the benefit of Korean Patent Application No. 10-2021-0098677, filed on Jul. 27, 2021, which is hereby incorporated by reference for all purposes as if fully set forth herein.

BACKGROUND

Field

Embodiments of the invention relate generally to a display device. More particularly, the invention relates to a screen saver controller, a display device including the screen saver controller, and a method of driving the display device including the screen saver controller.

Discussion of the Background

In general, a display device may include a display panel and a display panel driver. The display panel may include pixels, and an image corresponding to input image data may be displayed by using the pixels. The display panel may be connected to the display panel driver through gate lines and data lines. The display panel driver may include a gate driver configured to provide gate signals to the display panel through the gate lines, a data driver configured to provide data voltages to the display panel through the data lines, and a controller configured to control the gate driver and the data driver.

The display device may operate a screen saver mode under a predetermined condition. When the display device operates the screen saver mode, the display device may output a black image to the display panel, or may reduce a luminance of the display panel. A conventional display device has operated the screen saver mode without considering a load and a gray level. Therefore, the conventional display device has a limitation in minimizing power consumption and increasing a lifespan of the display panel.

The above information disclosed in this Background section is only for understanding of the background of the inventive concepts, and, therefore, it may contain information that does not constitute prior art.

SUMMARY

Embodiments of the invention provide a screen saver controller capable of providing a screen saver mode that minimizes (or reduces) power consumption of a display device.

Embodiments of the invention also provide a screen saver controller capable of increasing a lifespan of a display panel and improving visual recognition of an afterimage of the display panel.

Embodiments of the invention also provide a display device including the screen saver controller.

Embodiments of the invention also provide a method of driving a display device including the screen saver controller.

Additional features of the inventive concepts will be set forth in the description which follows, and in part will be apparent from the description, or may be learned by practice of the inventive concepts.

An embodiment of the invention provides a screen saver controller including a load calculator configured to generate load data of an image represented by input image data, a maximum gray level calculator configured to generate maximum gray level data of the image represented by the input image data, and a screen saver data generator configured to determine a gain of a screen saver mode based on the load data and the maximum gray level data when the screen saver mode is operated and to generate screen saver data based on the input image data and the gain.

The screen saver controller may further include a still image detector configured to detect a still image from the image represented by the input image data and to count a number of frames of the still image to generate still image data.

The screen saver mode may be operated when the number of the frames of the still image is greater than a reference number of frames.

The load calculator may be configured to calculate a sum of all gray levels of Nth frame data, where N is a positive integer, and to calculate a load of the Nth frame data based on the sum of all the gray levels of the Nth frame data.

The maximum gray level calculator may be configured to divide a display panel into a plurality of blocks, to calculate gray levels of the blocks, respectively, and to compare the gray levels of the blocks with each other to calculate a maximum gray level of the Nth frame data.

The maximum gray level calculator may be configured to compare a number of pixels having a highest gray level with a pre-stored reference number of pixels and to determine the highest gray level as the maximum gray level when the number of the pixels having the highest gray level is greater than or equal to the reference number of the pixels.

The screen saver data generator may be configured to determine a gain reduction start time by using a gain reduction start time lookup table in which a relation between the load data and the gain reduction start time and a relation between the maximum gray level and the gain reduction start time are defined.

The screen saver data generator may be configured to generate the screen saver data in which the gain reduction start time is set earlier as the load becomes greater and to generate the screen saver data in which the gain reduction start time is set earlier as the maximum gray level becomes greater.

The screen saver data generator may be configured to determine a gain reduction slope by using a gain reduction slope lookup table in which a relation between the load data and the gain reduction slope and a relation between the maximum gray level and the gain reduction slope are defined.

The screen saver data generator may be configured to generate the screen saver data in which the gain reduction slope of the screen saver mode is set to be larger as the load becomes greater and to generate the screen saver data in which the gain reduction slope is set to be larger as the maximum gray level becomes greater.

The screen saver data generator may be configured to determine a minimum luminance gain by using a minimum luminance gain lookup table in which a relation between the load data and the minimum luminance gain and a relation between the maximum gray level and the minimum luminance gain are defined.

The screen saver data generator may be configured to generate the screen saver data in which the minimum luminance gain is set to be smaller as the load becomes greater and to generate the screen saver data in which the minimum luminance gain is set to be smaller as the maximum gray level becomes greater.

Another embodiment of the invention provides a display device including a display panel including a plurality of pixels, a data driver configured to provide a data signal to the display panel, a screen saver controller configured to generate screen saver data for adjusting a luminance of the display panel based on input image data, and a controller configured to control the data driver, to provide the input image data to the screen saver controller, and to receive the screen saver data from the screen saver controller. The screen saver controller may include a load calculator configured to generate load data of an image represented by the input image data, a maximum gray level calculator configured to generate maximum gray level data of the image represented by the input image data, and a screen saver data generator configured to determine a gain of a screen saver mode based on the load data and the maximum gray level data when the screen saver mode is operated and to generate the screen saver data based on the input image data and the gain.

The screen saver controller may further include a still image detector configured to detect a still image from the image represented by the input image data and to count a number of frames of the still image to generate still image data.

The screen saver mode may be operated when the number of the frames of the still image is greater than a reference number of frames.

The load calculator may be configured to calculate a sum of all gray levels of Nth frame data, where N is a positive integer, and to calculate a load of the Nth frame data based on the sum of all the gray levels of the Nth frame data.

The maximum gray level calculator may be configured to divide the display panel into a plurality of blocks, to calculate gray levels of the blocks, respectively, and to compare the gray levels of the blocks with each other to calculate a maximum gray level of the Nth frame data.

The maximum gray level calculator may be configured to compare a number of pixels having a highest gray level with a pre-stored reference number of pixels and to determine the highest gray level as the maximum gray level when the number of the pixels having the highest gray level is greater than or equal to the reference number of the pixels.

Another embodiment of the invention provides a method of driving a display device including generating load data based on input image data, generating maximum gray level data based on the input image data, generating still image data based on the input image data, determining whether to operate a screen saver mode based on the still image data, determining a gain reduction start time of the screen saver mode based on the load data and the maximum gray level data, determining a gain reduction slope of the screen saver mode based on the load data and the maximum gray level data, determining a minimum luminance gain of the screen saver mode based on the load data and the maximum gray level data, generating screen saver data based on the gain reduction start time, the gain reduction slope, and the minimum luminance gain, and adjusting a luminance of a display panel based on the screen saver data.

Generating the load data may include calculating a sum of all gray levels of Nth frame data, where N is a positive integer, and calculating a load of the Nth frame data based on the sum of all the gray levels of the Nth frame data.

Generating the maximum gray level data may include dividing the display panel into a plurality of blocks, calculating gray levels of the blocks, respectively, and comparing the gray levels of the blocks with each other to calculate a maximum gray level of the Nth frame data.

Therefore, a screen saver controller according to the inventive concepts provides a screen saver mode optimized for a display panel by reflecting a load and a maximum gray level, so that power consumption of a display device can be minimized.

In addition, a screen saver controller according to the inventive concepts provides a screen saver mode optimized for a display panel by reflecting a load and a maximum gray level, so that visual recognition of an afterimage of the display panel can be improved, and a lifespan of the display panel can be increased.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION OF THE EMBODIMENTS

Figure 1:
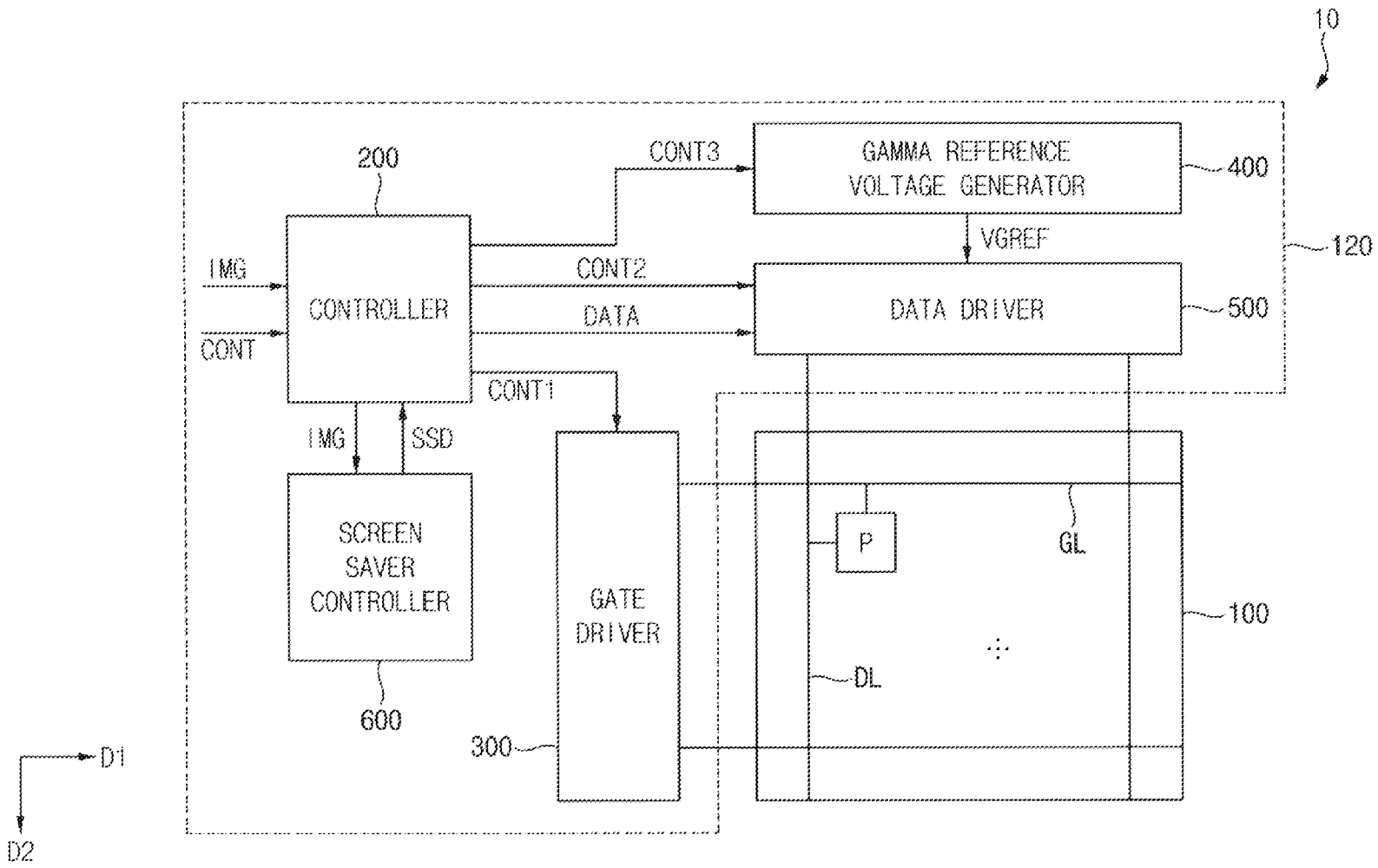
FIG. 1 is a block diagram illustrating a display device according to embodiments.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device according to embodiments.

Referring to FIG. 1, a display device 10 may include a display panel 100 and a display panel driver 120. The display panel driver 120 may include a controller 200, a gate driver 300, a gamma reference voltage generator 400, a data driver 500, and a screen saver controller 600.

The display panel 100 may include a display part for displaying an image and a peripheral part that is adjacent to the display part.

The display panel 100 may include pixels P, and may display an image corresponding to input image data by using the pixels P. Gate lines GL may extend in a first direction D1, and data lines DL may extend in a second direction D2 intersecting the first direction D1.

The display panel 100 may include a plurality of panel blocks. In other words, the display panel 100 may be divided into a plurality of panel blocks. Each of the panel blocks may include a plurality of pixels P. For example, the panel blocks may be large panel blocks, respectively. The large panel block may include 240*120 pixels P. Alternatively, the panel blocks may be small panel blocks, respectively. The small panel block may include 8*8 pixels P.

The controller 200 may receive input image data IMG and an input control signal CONT from an external device (not shown). For example, the input image data IMG received from the external device may include red image data, green image data, and blue image data. In some embodiments, the input image data IMG may further include white image data. Alternatively, the input image data IMG may include magenta image data, yellow image data, and cyan image data. Meanwhile, the input control signal CONT received from the external device may include a master clock signal, a data enable signal, a vertical synchronization signal, a horizontal synchronization signal, and the like.

The controller 200 may generate a first control signal CONT 1, a second control signal CONT2, a third control signal CONT3, and a data signal DATA based on the input image data IMG and the input control signal CONT.

The controller 200 may generate the first control signal CONT1 for controlling an operation of the gate driver 300 based on the input control signal CONT to output the generated first control signal CONT1 to the gate driver 300. The first control signal CONT1 may include a vertical start signal and a gate clock signal.

The controller 200 may generate the second control signal CONT2 for controlling an operation of the data driver 500 based on the input control signal CONT to output the generated second control signal CONT2 to the data driver 500. The second control signal CONT2 may include a horizontal start signal and a load signal.

The controller 200 may generate the data signal DATA based on the input image data IMG. The controller 200 may output the generated data signal DATA to the data driver 500.

The controller 200 may generate the third control signal CONT3 for controlling an operation of the gamma reference voltage generator 400 based on the input control signal CONT. The controller 200 may output the generated third control signal CONT3 to the gamma reference voltage generator 400.

The gate driver 300 may generate gate signals for driving the gate lines GL in response to the first control signal CONT1 received from the controller 200. The gate driver 300 may output the generated gate signals to the gate lines GL. For example, the gate driver 300 may sequentially output the gate signals to the gate lines GL. In some embodiments, the gate driver 300 may be mounted on the peripheral part of the display panel 100.

The gamma reference voltage generator 400 may generate a gamma reference voltage VGREF in response to the third control signal CONT3 received from the controller 200. The gamma reference voltage generator 400 may provide the generated gamma reference voltage VGREF to the data driver 500. The gamma reference voltage VGREF provided to the data driver 500 may have a value corresponding to each data signal DATA. In some embodiments, the gamma reference voltage generator 400 may be disposed in the controller 200 or the data driver 500.

The data driver 500 may receive the second control signal CONT2 and the data signal DATA from the controller 200, and receive the gamma reference voltage VGREF from the gamma reference voltage generator 400. The data driver 500 may convert a digital data signal DATA into an analog data voltage by using the gamma reference voltage VGREF. The data driver 500 may output data voltages to the data lines DL.

The screen saver controller 600 may receive the input image data IMG from the controller 200. The screen saver controller 600 may generate screen saver data SSD based on the input image data IMG to output the generated screen saver data SSD to the controller 200. An arrangement of the screen saver controller 600 in FIG. 1 is an example according to the inventive concepts. In some embodiments, the screen saver controller 600 may be disposed in the controller 200 as a part of the controller 200, or may be disposed outside the controller 200 to perform data interaction with the controller 200.

Figure 2:
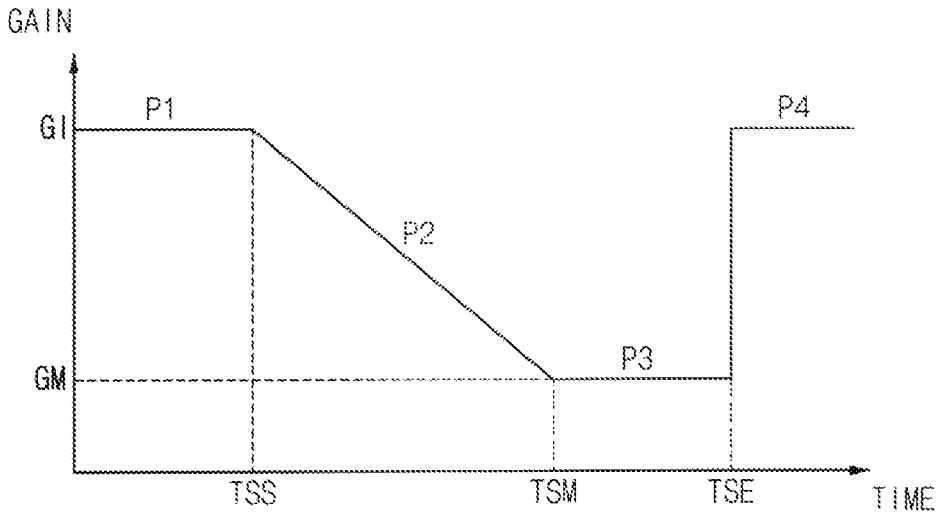
FIG. 2 is a graph illustrating a gain variation in a screen saver mode when the display device of FIG. 1 operates a screen saver mode.
Figure 3:
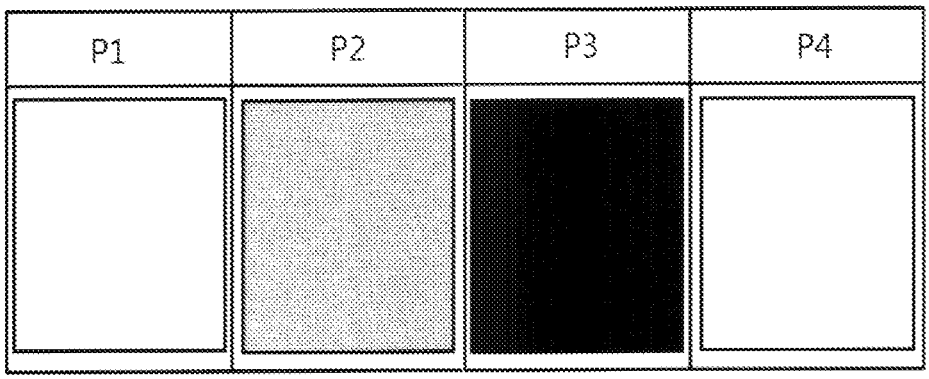
FIG. 3 is a diagram illustrating an example of a luminance variation of an image displayed on a display panel for each period in FIG. 2.

FIG. 2 is a graph illustrating a gain variation in a screen saver mode when the display device of FIG. 1 operates a screen saver mode, and FIG. 3 is a diagram illustrating an example of a luminance variation of an image displayed on a display panel for each period in FIG. 2.

Referring to FIGS. 1 to 3, the display device 10 may determine whether to operate the screen saver mode based on the input image data IMG. When the screen saver mode is operated, the display device 10 may generate the screen saver data. The display device 10 may adjust a luminance of the display panel 100 based on the screen saver data.

In an embodiment, before the screen saver mode is operated, the display device 10 may operate the display panel 100 with a constant luminance as in a first period P1 when an image input to the display panel 100 is constant. For example, a gain of the screen saver mode in the first period P1 may be an initial gain GI in which the screen saver mode is not operated.

When the display device 10 operates in the screen saver mode, the gain of the screen saver mode may be reduced to a minimum luminance gain GM as in a second period P2. In other words, the gain of the screen saver mode may start to decrease at a screen saver mode start time TSS, and the gain of the screen saver mode may be gradually reduced from the initial gain GI to the minimum luminance gain GM. In the second period P2, the luminance of the display panel 100 may be gradually reduced.

At a minimum luminance gain reaching time TSM that indicates a time when the gain of the screen saver mode is reduced to the minimum luminance gain GM, the display panel 100 may maintain the minimum luminance gain as in a third period P3. In the third period P3, the display panel 100 may be maintained at a minimum luminance.

The screen saver mode may end when a predetermined variation occurs in the image displayed on the display panel 100. For example, a screen saver mode end time TSE may be a time when the input image data changes from data representing a still image to data representing a moving image. At the screen saver mode end time TSE, as in a fourth period P4, the screen saver mode may be turned off, and the gain of the screen saver mode may be increased to the initial gain GI.

The display panel 100 may be affected by a load of the image represented by the input image data and a maximum gray level of the image represented by the input image data. For example, when the load of the image represented by the input image data is large, the display panel 100 may consume more power, and a lifespan of the display panel 100 may be shortened. For example, when the maximum gray level of the image represented by the input image data is high, the display panel 100 may consume more power, and the lifespan of the display panel 100 may be shortened. In an embodiment, the display device 10 may provide the screen saver mode optimized for the display panel 100 by reflecting the load and the maximum gray level, so that power consumption of the display device may be minimized, visual recognition of an afterimage of the display panel 100 may be improved, and the lifespan of the display panel 100 may be increased.

Figure 4:
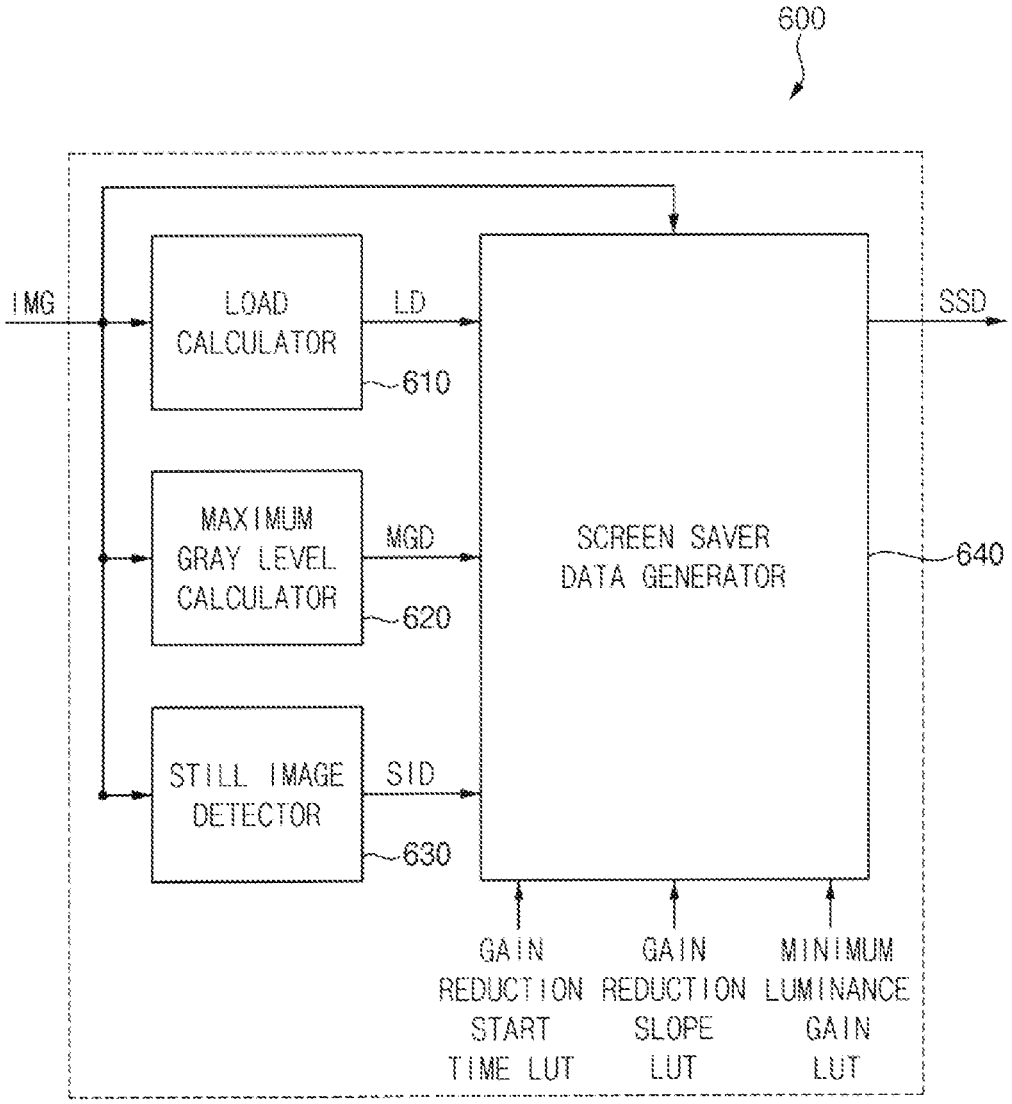
FIG. 4 is a block diagram illustrating a screen saver controller included in the display device of FIG. 1.
Figure 5:
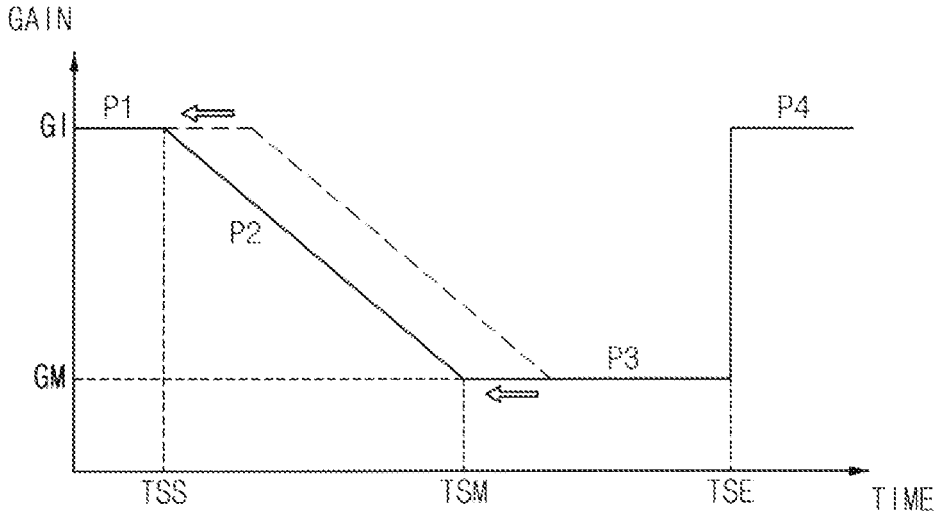
FIG. 5 is a graph illustrating a change in a gain reduction start time of a screen saver mode according to an operation of the screen saver controller of FIG. 4.
Figure 6:
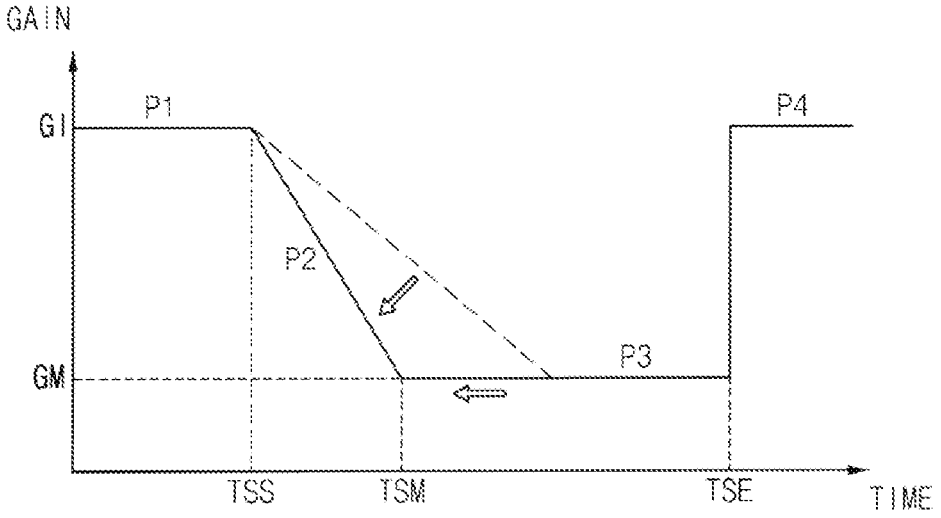
FIG. 6 is a graph illustrating a change in a gain reduction slope of a screen saver mode according to an operation of the screen saver controller of FIG. 4.
Figure 7:
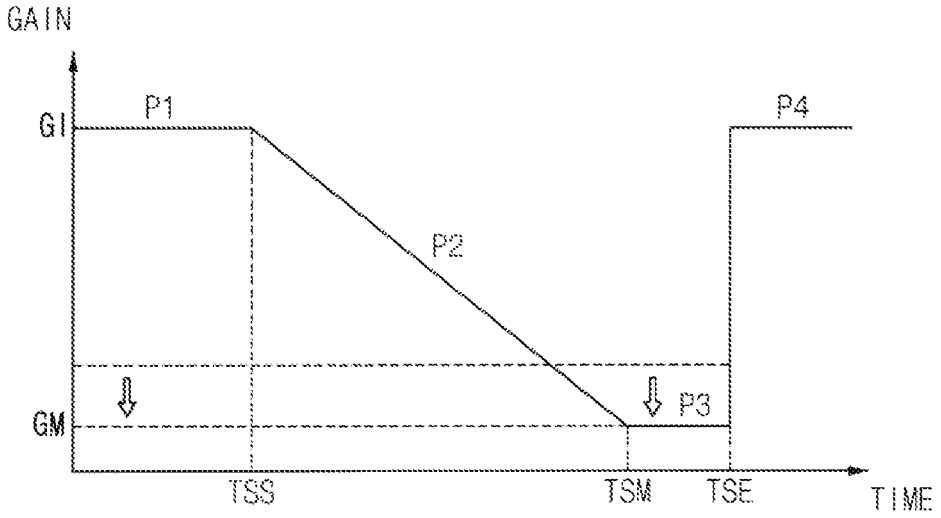
FIG. 7 is a graph illustrating a change in a minimum luminance gain of a screen saver mode according to an operation of the screen saver controller of FIG. 4.
Figure 8:
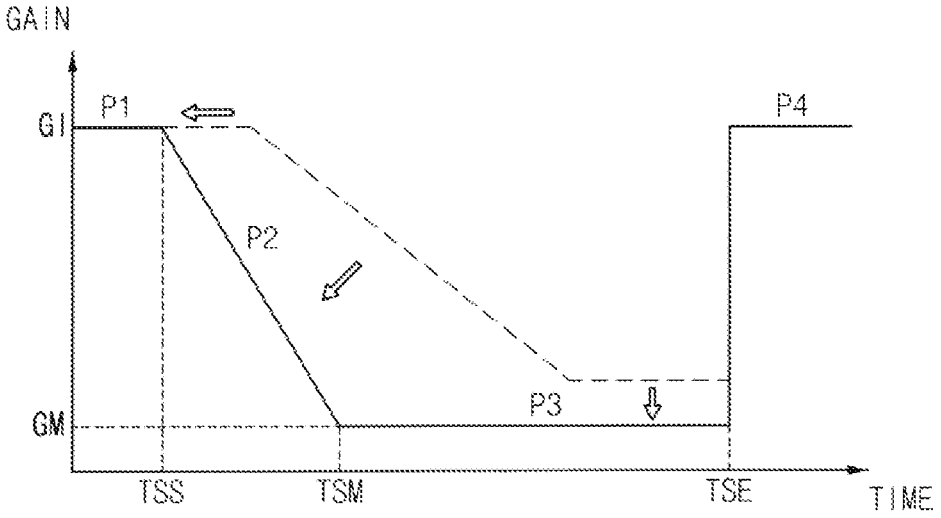
FIG. 8 is a graph illustrating an example of a change in a gain of a screen saver mode according to an operation of the screen saver controller of FIG. 4.
Figure 9A:
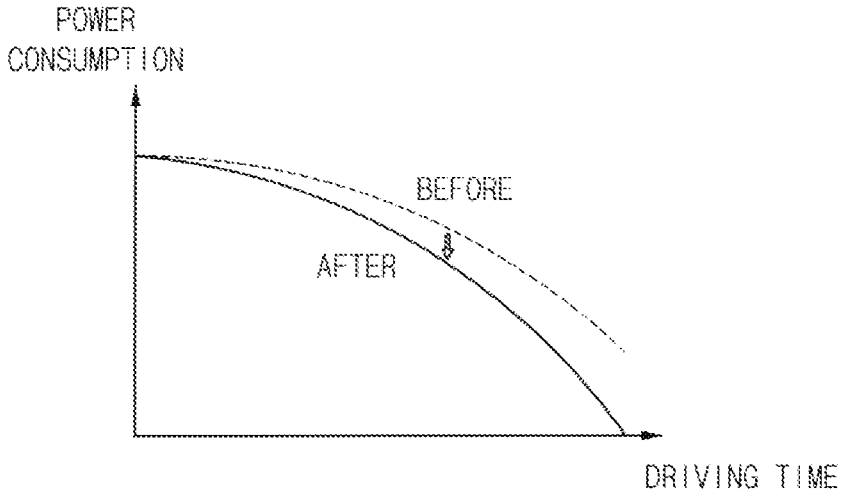
FIG. 9A is a graph for comparing power consumption according to a driving time before and after operating a screen saver mode according to embodiments.
Figure 9B:
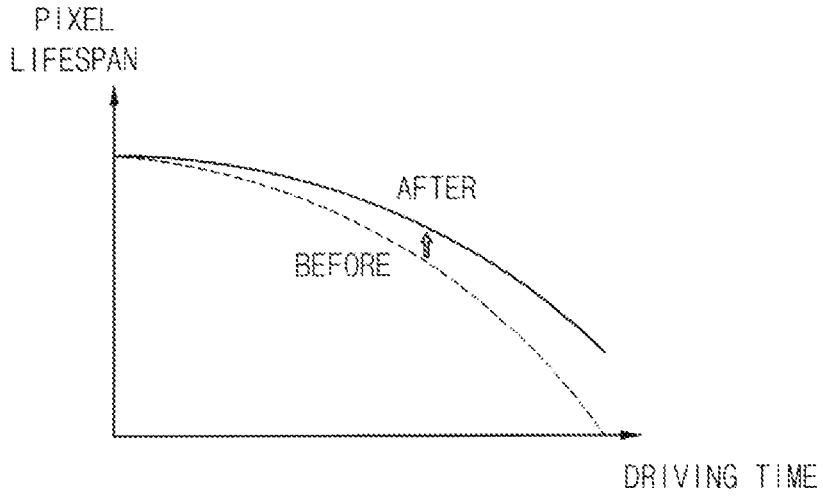
FIG. 9B is a graph for comparing a pixel lifespan according to a driving time before and after operating a screen saver mode according to embodiments.

FIG. 4 is a block diagram illustrating a screen saver controller included in the display device of FIG. 1; FIG. 5 is a graph illustrating a change in a gain reduction start time of a screen saver mode according to an operation of the screen saver controller of FIG. 4; FIG. 6 is a graph illustrating a change in a gain reduction slope of a screen saver mode according to an operation of the screen saver controller of FIG. 4; FIG. 7 is a graph illustrating a change in a minimum luminance gain of a screen saver mode according to an operation of the screen saver controller of FIG. 4; FIG. 8 is a graph illustrating an example of a change in a gain of a screen saver mode according to an operation of the screen saver controller of FIG. 4; FIG. 9A is a graph for comparing power consumption according to a driving time before and after operating a screen saver mode according to embodiments; and FIG. 9B is a graph for comparing a pixel lifespan according to a driving time before and after operating a screen saver mode according to embodiments.

Referring to FIGS. 1 to 4, according to embodiments, the screen saver controller 600 may include a load calculator 610 configured to generate load data LD, a maximum gray level calculator 620 configured to generate maximum gray level data MGD, a still image detector 630 configured to generate still image data SID, and a screen saver data generator 640 configured to generate screen saver data SSD.

The load calculator 610 may receive the input image data IMG, and generate the load data LD of the image represented by the input image data IMG. The load calculator 610 may receive $N^{th}$ frame data, where N is a positive integer, and calculate a sum of all gray levels of the $N^{th}$ frame data. For example, the load calculator 610 may divide the display panel 100 into the large panel blocks to calculate sums of gray levels of the large panel blocks, respectively. The large panel block may include 240*120 pixels P. The load calculator 610 may calculate the sum of all the gray levels of the $N^{th}$ frame data by summing up the sums of the gray levels of the large panel blocks. Alternatively, the load calculator 610 may divide the display panel 100 into the small panel blocks to calculate sums of gray levels of the small panel blocks, respectively. The small panel block may include 8*8 pixels P. The load calculator 610 may calculate the sum of all the gray levels of the $N^{th}$ frame data by summing up the sums of the gray levels of the small panel blocks. The load calculator 610 may calculate a load of the $N^{th}$ frame data based on the sum of all the gray levels of the $N^{th}$ frame data. The load may have a value between 0% and 100%. For example, when the $N^{th}$ frame data has a full black image, the load may be 0%. For example, when the $N^{th}$ frame data has a full white image, the load may be 100%. The load calculator 610 may generate the load data LD based on the load, and provide the load data LD to the screen saver data generator 640.

The maximum gray level calculator 620 may receive the input image data IMG, and generate the maximum gray level data MGD of the image represented by the input image data IMG. The maximum gray level calculator 620 may receive the $N^{th}$ frame data, and calculate a maximum gray level of the $N^{th}$ frame data. The maximum gray level calculator 620 may divide the display panel 100 into a plurality of blocks, and compare gray levels of the blocks with each other so as to calculate the maximum gray level of the $N^{th}$ frame data. For example, the maximum gray level calculator 620 may divide the display panel 100 into the large panel blocks (e.g., in a unit of 240*120 pixels) to determine a highest gray level among the gray levels of the large panel block. The maximum gray level calculator 620 may compare the highest gray levels among the gray levels of the large panel blocks with each other to calculate the maximum gray level of the $N^{th}$ frame data. Alternatively, the maximum gray level calculator 620 may divide the display panel 100 into the small panel blocks (e.g., in a unit of 8*8 pixels) to determine a highest gray level among the gray levels of the small panel block. The maximum gray level calculator 620 may compare the highest gray levels among the gray levels of the small panel blocks with each other to calculate the maximum gray level of the $N^{th}$ frame data. The display panel 100 may be configured such that a number of pixels P having the maximum gray level may be greater than or equal to a reference number of pixels. For example, the maximum gray level calculator 620 may compare a number of pixels P having the highest gray level with a pre-stored reference number of pixels, and determine the highest gray level as the maximum gray level when the number of the pixels P having the highest gray level is greater than or equal to the reference number of pixels. The maximum gray level calculator 620 may generate the maximum gray level data MGD, and provide the maximum gray level data MGD to the screen saver data generator 640.

The still image detector 630 may receive the input image data IMG, and generate the still image data SID based on the input image data IMG. The still image detector 630 may analyze the input image data IMG to detect a still image from the image represented by the input image data IMG. The still image detector 630 may count a number of frames of the still image so as to generate the still image data SID. In detail, the still image detector 630 may compare input image data IMG in a previous frame with input image data IMG in a current frame. The still image detector 630 may determine that the image represented by the input image data IMG is the still image when the input image data IMG in the previous frame is the same as the input image data IMG in the current frame. The still image detector 630 may count the number of the frames of the still image, and generate the still image data SID including the number of the frames of the still image. The still image detector 630 may generate the still image data SID, and provide the still image data SID to the screen saver data generator 640.

The screen saver data generator 640 may receive the still image data SID from the still image detector 630, and compare the number of the frames of the still image with the reference number of the frames. The display device 10 may operate the screen saver mode when the number of the frames of the still image is greater than the reference number of the frames.

The screen saver data generator 640 may receive the load data LD from the load calculator 610, and receive the maximum gray level data MGD from the maximum gray level calculator 620. The screen saver data generator 640 may determine the gain of the screen saver mode based on the load data LD and the maximum gray level data MGD when the screen saver mode is operated. The gain of the screen saver mode may include a gain reduction start time, a gain reduction slope, and a minimum luminance gain. For example, the screen saver data generator 640 may determine the gain reduction start time of the screen saver mode, the gain reduction slope of the screen saver mode, and the minimum luminance gain of the screen saver mode based on the load data LD and the maximum gray level data MGD. The screen saver data generator 640 may generate the screen saver data SSD based on the input image data IMG and the gain of the screen saver mode.

The screen saver data generator 640 may determine the gain reduction start time by using a gain reduction start time lookup table. The screen saver data generator 640 may determine the gain reduction start time in which the load data LD is reflected by using the gain reduction start time lookup table in which a relation between the load data LD and the gain reduction start time is defined. For example, the screen saver data generator 640 may determine the gain reduction start time in which the maximum gray level data MGD is reflected by using the gain reduction start time lookup table in which a relation between the maximum gray level data MGD and the gain reduction start time is defined.

The screen saver data generator 640 may generate the screen saver data SSD in which the gain reduction start time is set earlier as the load becomes larger. The screen saver data generator 640 may generate the screen saver data SSD in which the gain reduction start time is set earlier as the maximum gray level becomes larger. As shown in FIG. 5, the screen saver data generator 640 may determine the gain reduction start time to be set earlier by reflecting the load data LD and the maximum gray level data MGD. For example, the screen saver data generator 640 may move the screen saver mode start time TSS such that the screen saver mode start time may be set earlier. When the screen saver mode start time TSS is set earlier, the minimum luminance gain reaching time TSM may also be set earlier. As a result, when the screen saver mode start time is set earlier, a time during which the display panel 100 displays an image having a high luminance may be shortened.

Although FIG. 5 illustrates a case where the screen saver mode start time is set earlier, the screen saver data generator 640 is not limited thereto. For example, the screen saver data generator 640 may generate the screen saver data SSD in which the screen saver mode start time is fixed according to the load and the maximum gray level. Alternatively, the screen saver data generator 640 may generate the screen saver data SSD in which the screen saver mode start time is set later according to the load and the maximum gray level.

The screen saver data generator 640 may determine the gain reduction slope by using a gain reduction slope lookup table. The screen saver data generator 640 may determine the gain reduction slope in which the load data LD is reflected by using the gain reduction slope lookup table in which a relation between the load data LD and the gain reduction slope is defined. For example, the screen saver data generator 640 may determine the gain reduction slope in which the maximum gray level data MGD is reflected by using the gain reduction slope lookup table in which a relation between the maximum gray level data MGD and the gain reduction slope is defined.

The screen saver data generator 640 may generate the screen saver data SSD in which the gain reduction slope is set to be larger as the load becomes greater. The screen saver data generator 640 may generate the screen saver data SSD in which the gain reduction slope is set to be larger as the maximum gray level becomes larger. As shown in FIG. 6, the screen saver data generator 640 may determine the gain reduction slope such that the gain reduction slope of the screen saver mode is set to be larger by reflecting the load data LD and the maximum gray level data MGD. For example, the screen saver data generator 640 may determine the gain reduction slope to be set larger such that the gain of the screen saver mode is reduced more rapidly in the second period P2. When the gain reduction slope is set to be larger, the minimum luminance gain reaching time TSM may be set earlier. As a result, when the gain reduction slope of the screen saver mode is set to be larger, the time during which the display panel 100 displays the image having the high luminance may be shortened.

Although FIG. 6 illustrates a case where the gain reduction slope of the screen saver mode is set to be larger, the screen saver data generator 640 is not limited thereto. For example, the screen saver data generator 640 may generate the screen saver data SSD in which the gain reduction slope of the screen saver mode is fixed according to the load and the maximum gray level. Alternatively, the screen saver data generator 640 may generate the screen saver data SSD in which the gain reduction slope of the screen saver mode is set to be smaller according to the load and the maximum gray level.

The screen saver data generator 640 may determine the minimum luminance gain by using a minimum luminance gain lookup table. The screen saver data generator 640 may determine the minimum luminance gain in which the load data LD is reflected by using the minimum luminance gain lookup table in which a relation between the load data LD and the minimum luminance gain is defined. For example, the screen saver data generator 640 may determine the minimum luminance gain in which the maximum gray level data MGD is reflected by using the minimum luminance gain lookup table in which a relation between the maximum gray level data MGD and the minimum luminance gain is defined.

The screen saver data generator 640 may generate the screen saver data SSD in which the minimum luminance gain is set to be smaller as the load becomes larger. The screen saver data generator 640 may generate the screen saver data SSD in which the minimum luminance gain is set to be smaller as the maximum gray level becomes larger. As shown in FIG. 7, the screen saver data generator 640 may determine the minimum luminance gain GM of the screen saver mode to be set smaller by reflecting the load data LD and the maximum gray level data MGD. When the minimum luminance gain GM is set to be smaller, the display panel 100 may be maintained at a lower luminance in the third period P3. As a result, when the minimum luminance gain of the screen saver mode is set to be smaller, the visual recognition of the afterimage of the display panel 100 may be minimized.

Although FIG. 7 has illustrated a case where the minimum luminance gain of the screen saver mode is set to be smaller, the screen saver data generator 640 is not limited thereto. For example, the screen saver data generator 640 may generate the screen saver data SSD in which the minimum luminance gain of the screen saver mode is fixed according to the load and the maximum gray level. Alternatively, the screen saver data generator 640 may generate the screen saver data SSD in which the minimum luminance gain of the screen saver mode is set to be larger according to the load and the maximum gray level.

The screen saver data generator 640 may determine the gain of the screen saver mode by using the gain reduction start time lookup table, the gain reduction slope lookup table, and the minimum luminance gain lookup table. As shown in FIG. 8, the screen saver data generator 640 may simultaneously adjust the gain reduction start time, the gain reduction slope, and the minimum luminance gain by reflecting the load data LD and the maximum gray level data MGD. The screen saver data generator 640 may generate the gain of the screen saver mode by simultaneously adjusting the gain reduction start time, the gain reduction slope, and the minimum luminance gain, so that the screen saver data generator 640 may generate the screen saver data SSD optimized for the load and the maximum gray level. For example, the screen saver data generator 640 may move the screen saver mode start time TSS such that the screen saver mode start time may be set earlier, determine the gain reduction slope to be set larger such that the gain of the screen saver mode is reduced more rapidly in the second period P2, and determine the minimum luminance gain of the screen saver mode to be set smaller, in proportion to the load and the maximum gray level. In other words, the screen saver data generator 640 may generate the screen saver data SSD in which the minimum luminance gain reaching time TSM of the screen saver mode is set earlier, and the display panel 100 is maintained at a lower luminance in the third period P3 in proportion to the load and the maximum gray level.

As shown in FIGS. 9A and 9B, the display device 10 according to embodiments may provide the screen saver mode optimized for the display panel 100 by reflecting the load and maximum gray level, so that the power consumption of the display device 10 may be minimized. When the screen saver mode according to the inventive concepts is continuously operated, as a driving time of the display device 10 increases, the power consumption of the display device 10 may be reduced more effectively as compared with the related art. In addition, the display device 10 according to embodiments may provide the screen saver mode optimized for the display panel 100 by reflecting the load and maximum gray level, so that the visual recognition of the afterimage of the display panel 100 may be improved, and the lifespan of the display panel 100 may be increased. When the screen saver mode according to the inventive concepts is continuously operated, as the driving time of the display device 10 increases, pixel lifespans of the pixels P included in the display panel 100 may be increased more effectively as compared with the related art.

Figure 10:
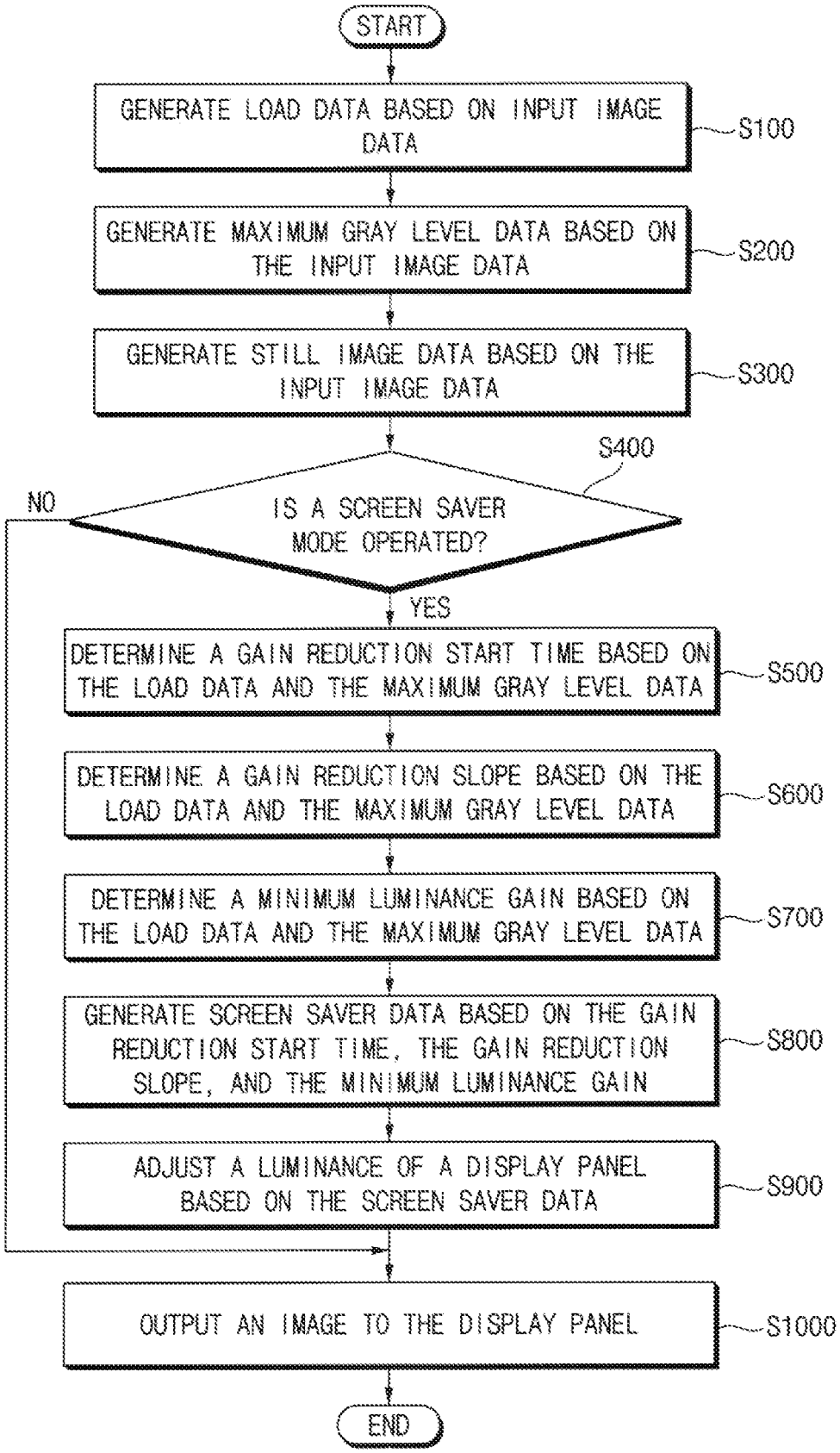
FIG. 10 is a flowchart illustrating an operation of the display device of FIG. 1.

FIG. 10 is a flowchart illustrating an operation of the display device of FIG. 1.

Referring to FIGS. 1 and 4 to 10, the display device 10 may generate load data LD based on input image data IMG (S100), may generate maximum gray level data MGD based on the input image data IMG (S200), may generate still image data SID based on the input image data IMG (S300), may determine whether to operate a screen saver mode (S400), may determine a gain reduction start time based on the load data LD and the maximum gray level data MGD (S500), may determine a gain reduction slope based on the load data LD and the maximum gray level data MGD (S600), may determine a minimum luminance gain based on the load data LD and the maximum gray level data MGD (S700), may generate screen saver data SSD based on the gain reduction start time, the gain reduction slope, and the minimum luminance gain (S800), may adjust a luminance of a display panel 100 based on the screen saver data (SSD) (S900), and may output an image to the display panel 100 (S1000).

In an embodiment, the display device 10 may generate the load data LD based on the input image data IMG (S100). In detail, the load calculator 610 may receive the input image data IMG, and generate the load data LD of an image represented by the input image data IMG. The load calculator 610 may receive $N^{th}$ frame data, and calculate a sum of all gray levels of the $N^{th}$ frame data. The load calculator 610 may calculate a load of the $N^{th}$ frame data based on the sum of all the gray levels of the $N^{th}$ frame data. The load calculator 610 may generate the load data LD based on the load, and provide the load data LD to the screen saver data generator 640.

In an embodiment, the display device 10 may generate the maximum gray level data MGD based on the input image data IMG (S200). In detail, the maximum gray level calculator 620 may receive the input image data IMG, and generate the maximum gray level data MGD of the image represented by the input image data IMG. The maximum gray level calculator 620 may receive the $N^{th}$ frame data, and calculate a maximum gray level of the $N^{th}$ frame data. The maximum gray level calculator 620 may divide the display panel 100 into a plurality of blocks, and compare gray levels of the blocks with each other so as to calculate the maximum gray level of the $N^{th}$ frame data. The display panel 100 may be configured such that a number of pixels P having the maximum gray level may be greater than or equal to a reference number of pixels. For example, the maximum gray level calculator 620 may compare a number of pixels P having the highest gray level with a pre-stored reference number of pixels, and determine the highest gray level as the maximum gray level when the number of the pixels P having the highest gray level is greater than or equal to the reference number of the pixels. The maximum gray level calculator 620 may generate the maximum gray level data MGD, and provide the maximum gray level data MGD to the screen saver data generator 640.

In an embodiment, the display device 10 may generate the still image data SID based on the input image data IMG (S300). In detail, the still image detector 630 may receive the input image data IMG, and generate the still image data SID based on the input image data IMG. The still image detector 630 may analyze the input image data IMG to detect a still image from the image represented by the input image data IMG. The still image detector 630 may count a number of frames of the still image, and generate the still image data SID including the number of the frames of the still image. The still image detector 630 may generate the still image data SID, and provide the still image data SID to the screen saver data generator 640.

In an embodiment, the display device 10 may determine whether to operate the screen saver mode (S400). In detail, the screen saver data generator 640 may receive the still image data SID from the still image detector 630, and compare the number of the frames of the still image with the reference number of the frames. The display device 10 may operate the screen saver mode when the number of the frames of the still image is greater than the reference number of the frames.

In an embodiment, the display device 10 may determine the gain reduction start time, the gain reduction slope, and the minimum luminance gain based on the load data LD and the maximum gray level data MGD (S500, S600, and S700), and generate the screen saver data SSD based on the gain reduction start time, the gain reduction slope, and the minimum luminance gain (S800). In detail, the screen saver data generator 640 may receive the load data LD from the load calculator 610, and receive the maximum gray level data MGD from the maximum gray level calculator 620. The screen saver data generator 640 may determine a gain of the screen saver mode by using a gain reduction start time lookup table in which a relation between the load data LD and the gain reduction start time and a relation between the maximum gray level data MGD and the gain reduction start time are defined, respectively, a gain reduction slope lookup table in which a relation between the load data LD and the gain reduction slope and a relation between the maximum gray level data MGD and the gain reduction slope are defined, respectively, and a minimum luminance gain lookup table in which a relation between the load data LD and the minimum luminance gain and a relation between the maximum gray level data MGD and the minimum luminance gain are defined, respectively. The screen saver data generator 640 may generate the gain of the screen saver mode by simultaneously adjusting the gain reduction start time, the gain reduction slope, and the minimum luminance gain, and generate the screen saver data SSD optimized for the load and the maximum gray level based on the gain. For example, the screen saver data generator 640 may generate the screen saver data SSD in which the screen saver mode start time is set earlier, the gain reduction slope of the screen saver mode is set to be larger, and the minimum luminance gain of the screen saver mode is set to be smaller in proportion to the load and the maximum gray level.

In an embodiment, the display device 10 may adjust the luminance of the display panel 100 based on the screen saver data SSD (S900), and output the image to the display panel 100 (S1000). As described above, the display device 10 according to embodiments may provide the screen saver mode optimized for the display panel 100 by reflecting the load and the maximum gray level, so that the power consumption of the display device 10 may be minimized, the visual recognition of the afterimage of the display panel 100 may be improved, and the lifespan of the display panel 100 may be increased.

Figure 11:
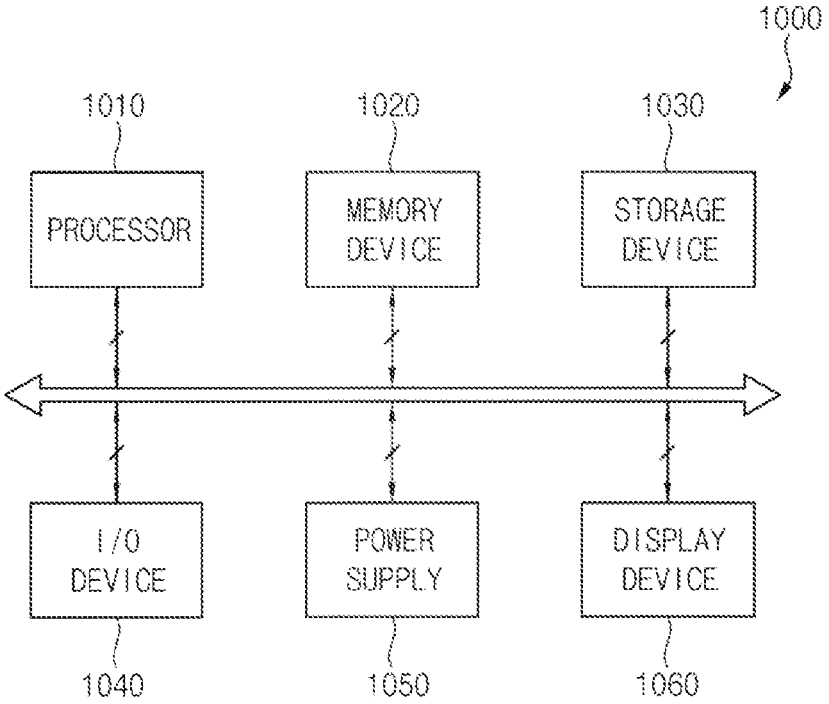
FIG. 11 is a block diagram illustrating an electronic device according to embodiments.
Figure 12:
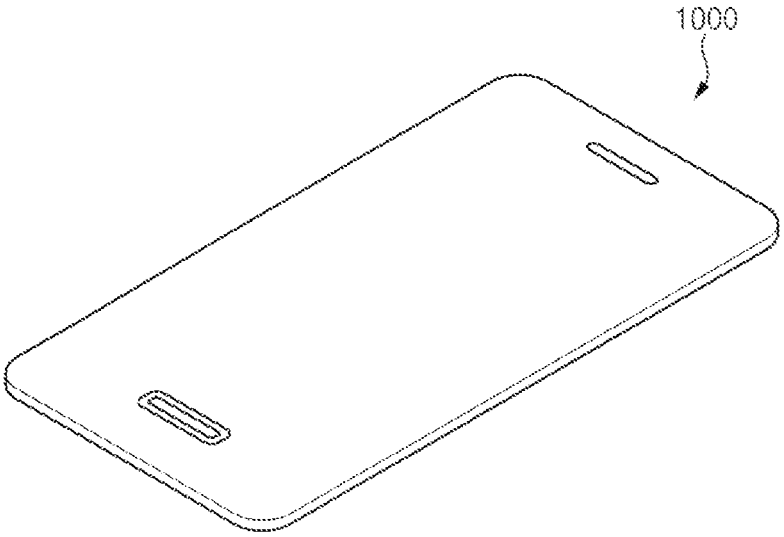
FIG. 12 is a diagram illustrating an example in which the electronic device of FIG. 11 is implemented as a smart phone.

FIG. 11 is a block diagram illustrating an electronic device according to embodiments, and FIG. 12 is a diagram illustrating an example in which the electronic device of FIG. 11 is implemented as a smart phone.

Referring to FIGS. 11 and 12, the electronic device 1000 may include a processor 1010, a memory device 1020, a storage device 1030, an input/output (I/O) device 1040, a power supply 1050, and a display device 1060. Here, the display device 1060 may be the display device 10 of FIG. 1. In addition, the electronic device 1000 may further include a plurality of ports for communicating with a video card, a sound card, a memory card, a universal serial bus (USB) device, other electronic devices, etc. In an embodiment, as illustrated in FIG. 12, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a head mounted display (HMD) device, etc.

The processor 1010 may perform various computing functions. The processor 1010 may be a micro processor, a central processing unit (CPU), an application processor (AP), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc and/or at least one volatile memory device such as a dynamic random access memory (DRAM) device, a static random access memory (SRAM) device, a mobile DRAM device, etc. The storage device 1030 may include a solid-state drive (SSD) device, a hard disk drive (HDD) device, a CD-ROM device, etc. The I/O device 1040 may include an input device such as a keyboard, a keypad, a mouse device, a touch pad, a touch screen, etc, and an output device such as a printer, a speaker, etc. In some embodiments, the I/O device 1040 may include the display device 1060. The power supply 1050 may provide power for operations of the electronic device 1000. The display device 1060 may be coupled to other components via the buses or other communication links.

The display device 1060 may display an image corresponding to visual information of the electronic device 1000. Here, the display device 1060 may operate a screen saver mode by reflecting a load and a maximum gray level of an image indicated by input image data. To this end, the display device 1060 may include a display panel including a plurality of pixels, a data driver configured to provide a data signal to the display panel, a gate driver configured to provide a gate signal to the display panel, a screen saver controller configured to generate screen saver data for adjusting a luminance of the display panel based on input image data, and a controller configured to control the data driver and the gate driver, provide the input image data to the screen saver controller, and receive the screen saver data from the screen saver controller. The screen saver controller may include a load calculator configured to generate load data of an image represented by the input image data, a maximum gray level calculator configured to generate maximum gray level data of the image represented by the input image data, and a screen saver data generator configured to receive the load data and the maximum gray level data, determine a gain of a screen saver mode based on the load data and the maximum gray level data when the screen saver mode is operated, and generate the screen saver data based on the input image data and the gain. Accordingly, the display device 1060 according to embodiments may provide the screen saver mode optimized for the display panel by reflecting the load and the maximum gray level, so that power consumption of the display device may be minimized, visual recognition of an afterimage of the display panel may be improved, and a lifespan of the display panel may be increased. Since these are described above, duplicated description related thereto will not be repeated.

The inventive concepts may be applied to a display device and an electronic device including the display device. For example, the present disclosure may be applied to a cellular phone, a smart phone, a video phone, a smart pad, a smart watch, a tablet PC, a car navigation system, a television, a computer monitor, a laptop, a digital camera, a head mounted display device, etc.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A screen saver controller comprising:

a load calculator configured to generate load data of an image represented by input image data;

a maximum gray level calculator configured to generate maximum gray level data of the image represented by the input image data; and a screen saver data generator configured to determine a gain of a screen saver mode based on the load data and the maximum gray level data when the screen saver mode is operated and to generate screen saver data based on the input image data and the gain, wherein:

the load calculator is configured to calculate a sum of all gray levels of $N^{th}$ frame data, where N is a positive integer, and to calculate a load of the $N^{th}$ frame data based on the sum of all the gray levels of the $N^{th}$ frame data;

the maximum gray level calculator is configured to divide a display panel into a plurality of blocks, to calculate gray levels of the blocks, respectively, and to compare the gray levels of the blocks with each other to calculate a maximum gray level of the $N^{th}$ frame data; and the maximum gray level calculator is configured to compare a number of pixels having a highest gray level with a pre-stored reference number of pixels and to determine the highest gray level as the maximum gray level when the number of the pixels having the highest gray level is greater than or equal to the reference number of the pixels.

2. The screen saver controller of claim 1, further comprising a still image detector configured to detect a still image from the image represented by the input image data and to count a number of frames of the still image to generate still image data.

3. The screen saver controller of claim 2, wherein the screen saver mode is operated when the number of the frames of the still image is greater than a reference number of frames.

4. The screen saver controller of claim 1, wherein the screen saver data generator is configured to determine a gain reduction start time by using a gain reduction start time lookup table in which a relation between the load data and the gain reduction start time and a relation between the maximum gray level and the gain reduction start time are defined.

5. The screen saver controller of claim 4, wherein the screen saver data generator is configured to generate the screen saver data in which the gain reduction start time is set earlier as the load becomes greater and to generate the screen saver data in which the gain reduction start time is set earlier as the maximum gray level becomes larger.

6. The screen saver controller of claim 1, wherein the screen saver data generator is configured to determine a gain reduction slope by using a gain reduction slope lookup table in which a relation between the load data and the gain reduction slope and a relation between the maximum gray level and the gain reduction slope are defined.

7. The screen saver controller of claim 6, wherein the screen saver data generator is configured to generate the screen saver data in which the gain reduction slope of the screen saver mode is set to be larger as the load becomes greater and to generate the screen saver data in which the gain reduction slope is set to be larger as the maximum gray level becomes larger.

8. The screen saver controller of claim 1, wherein the screen saver data generator is configured to determine a minimum luminance gain by using a minimum luminance gain lookup table in which a relation between the load data and the minimum luminance gain and a relation between the maximum gray level and the minimum luminance gain are defined.

9. The screen saver controller of claim 8, wherein the screen saver data generator is configured to generate the screen saver data in which the minimum luminance gain is set to be smaller as the load becomes greater and to generate the screen saver data in which the minimum luminance gain is set to be smaller as the maximum gray level becomes larger.

10. A display device comprising:

a display panel including a plurality of pixels;

a data driver configured to provide a data signal to the display panel;

a screen saver controller configured to generate screen saver data for adjusting a luminance of the display panel based on input image data; and a controller configured to control the data driver, to provide the input image data to the screen saver controller, and to receive the screen saver data from the screen saver controller, wherein:

the screen saver controller includes:

a load calculator configured to generate load data of an image represented by the input image data;

maximum gray level calculator configured to generate maximum gray level data of the image represented by the input image data; and a screen saver data generator configured to determine a gain of a screen saver mode based on the load data and the maximum gray level data when the screen saver mode is operated and to generate the screen saver data based on the input image data and the gain;

the load calculator is configured to calculate a sum of all gray levels of $N^{th}$ frame data, where N is a positive integer, and to calculate a load of the $N^{th}$ frame data based on the sum of all the gray levels of the $N^{th}$ frame data;

the maximum gray level calculator is configured to divide the display panel into a plurality of blocks, to calculate gray levels of the blocks, respectively, and to compare the gray levels of the blocks with each other to calculate a maximum gray level of the $N^{th}$ frame data; and the maximum gray level calculator is configured to compare a number of pixels having a highest gray level with a pre-stored reference number of pixels and to determine the highest gray level as the maximum gray level when the number of the pixels having the highest gray level is greater than or equal to the reference number of the pixels.

11. The display device of claim 10, wherein the screen saver controller further includes:

a still image detector configured to detect a still image from the image represented by the input image data and to count a number of frames of the still image to generate still image data.

12. The display device of claim 11, wherein the screen saver mode is operated when the number of the frames of the still image is greater than a reference number of frames.

13. A method of driving a display device, the method comprising:

generating load data based on input image data;

generating maximum gray level data based on the input image data;

generating still image data based on the input image data;

determining whether to operate a screen saver mode based on the still image data;

determining a gain reduction start time of the screen saver mode based on the load data and the maximum gray level data;

determining a gain reduction slope of the screen saver mode based on the load data and the maximum gray level data;

determining a minimum luminance gain of the screen saver mode based on the load data and the maximum gray level data;

generating screen saver data based on the gain reduction start time, the gain reduction slope, and the minimum luminance gain; and adjusting a luminance of a display panel based on the screen saver data, wherein:

generating the load data includes:

calculating a sum of all gray levels of $N^{th}$ frame data, where N is a positive integer; and calculating a load of the $N^{th}$ frame data based on the sum of all the gray levels of the $N^{th}$ frame data; and generating the maximum gray level data includes:

dividing the display panel into a plurality of blocks;

calculating gray levels of the blocks, respectively;

comparing the gray levels of the blocks with each other to calculate a maximum gray level of the $N^{th}$ frame data;

comparing a number of pixels having a highest gray level with a pre-stored reference number of pixels; and determining the highest gray level as the maximum gray level when the number of the pixels having the highest gray level is greater than or equal to the reference number of the pixels.

* * * * *